US012753462B2

(12) United States Patent
Resiak et al.

(10) Patent No.: US 12,753,462 B2
(45) Date of Patent: Oct. 6, 2026

(54) METHOD FOR PRODUCING A STEEL PART AND STEEL PART

(71) Applicant: ArcelorMittal, Luxembourg (LU)

(72) Inventors: Bernard Resiak, Saulny (FR); Marion Frotey, Valleroy (FR)

(73) Assignee: ArcelorMittal, Luxembourg (LU)

( * ) Notice: Subject to any disclaimer, the term of this patent is extended or adjusted under 35 U.S.C. 154(b) by 826 days.

(21) Appl. No.: 17/627,636

(22) PCT Filed: Jul. 16, 2020

(86) PCT No.: PCT/IB2020/056695

§ 371 (c)(1),
(2) Date: Jan. 14, 2022

(87) PCT Pub. No.: WO2021/009705

PCT Pub. Date: Jan. 21, 2021

(65) Prior Publication Data

US 2022/0259693 A1 Aug. 18, 2022

(30) Foreign Application Priority Data

Jul. 16, 2019 (WO) ..... PCT/IB2019/056061

(51) Int. Cl.

| | |
|---|---|
| ***C21D 9/52*** | (2006.01) |
| ***C21D 6/00*** | (2006.01) |
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 9/525* (2013.01); *C21D 6/004* (2013.01); *C21D 6/005* (2013.01); *C21D 6/008* (2013.01); *C21D 8/06* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/54* (2013.01); *C21D 2211/002* (2013.01); *C21D 2211/008* (2013.01)

(58) Field of Classification Search

CPC ..... C21D 9/525; C21D 6/004; C21D 6/005; C21D 6/008; C21D 8/065; C21D 2211/002; C21D 2211/008; C21D 2211/001; C22C 38/001; C22C 38/02; C22C 38/04; C22C 38/44; C22C 38/54; C22C 38/58

See application file for complete search history.

(56) References Cited

U.S. PATENT DOCUMENTS

| | | | | |
|---|---|---|---|---|
| 6,390,924 | B1 * | 5/2002 | Yoshida | C22C 38/002 464/902 |
| 2009/0107588 | A1 * | 4/2009 | Allain | C21D 8/02 148/547 |
| 2010/0135745 | A1 | 6/2010 | Resiak | |
| 2011/0132502 | A1 | 6/2011 | Bian | |
| 2014/0283960 | A1 | 9/2014 | Liu et al. | |
| 2017/0044635 | A1 | 2/2017 | Sourmail et al. | |
| 2021/0115527 | A1 * | 4/2021 | Chen | C22C 38/22 |

FOREIGN PATENT DOCUMENTS

| | | | | |
|---|---|---|---|---|
| CN | 101613830 | A | * | 12/2009 |
| CN | 101654728 | A | | 2/2010 |
| CN | 103160736 | A | * | 6/2013 |
| DE | 102008022401 | A1 | | 11/2009 |
| EP | 1178126 | A1 | | 2/2002 |
| EP | 2134882 | A2 | | 12/2009 |
| EP | 2982771 | A1 | | 2/2016 |
| JP | 2009293106 | A | * | 12/2009 |
| JP | 2018048374 | A | * | 3/2018 |
| KR | 100368226 | B1 | | 4/2003 |
| WO | WO2009135776 | A1 | | 11/2009 |
| WO | WO2010112611 | A1 | | 10/2010 |

OTHER PUBLICATIONS

Search Report for PCT/IB2020/056695.

* cited by examiner

*Primary Examiner* — Christina A Johnson
(74) *Attorney, Agent, or Firm* — Davidson Kappel LLC

(57) ABSTRACT

Method for producing a steel part comprising providing a semi-finished product made of a steel comprising, by weight: 0.35%≤C≤0.60%; 0.15%≤Si≤0.5%; 0.8%≤Mn≤2.0%; 0.0003%≤B≤0.01%; 0.003%≤Mo≤1.0%; 1.0%≤Cr≤2.0%; 0.01%≤Ti≤0.04%; 0.003%≤N≤0.01%; S≤0.015%; P≤0.015%; 0.01%≤Ni≤1.0%; 0.01%≤Nb≤0.1%; optionally 0≤Al≤0.1%; 0≤V≤0.5%; and the remainder consisting of iron and unavoidable impurities. The method further including annealing this semi-finished product at a temperature strictly lower than the Ac1 temperature of the steel; cold forming the semi-finished product into a cold formed product; subjecting the cold formed product to a heat treatment comprising heating the cold formed product to a temperature greater than or equal to the Ac3 temperature of the steel; and holding the product at a holding temperature comprised between 300° C. and 400° C. for a time comprised between 15 minutes and 2 hours.

22 Claims, No Drawings

METHOD FOR PRODUCING A STEEL PART AND STEEL PART

The present disclosure relates to a method for manufacturing through cold forming, in particular via cold heading, assembly parts, such as screws, bolts, etc., that the automotive industry commonly uses for assembling ground contact or engine components of vehicles.

BACKGROUND

As is known, the automotive industry continually aims to increase the power of engines, and, at the same time, seeks to reduce the weight thereof. The weight reduction requires an increasingly reduced size of the parts. These parts, however, remain subject to the same mechanical stresses, and must therefore have increasingly high mechanical properties, in particular tensile strength.

Prior patent application US 2010/0135745 describes a method for manufacturing assembly parts, such as screws and bolts, for motor vehicles, comprising quenching followed by tempering so as to obtain parts having a microstructure consisting essentially of tempered martensite. Such parts have a tensile strength from 1200 MPa to more than 1500 MPa, which is satisfactory for the above-mentioned applications.

SUMMARY

However, it is desirable to further improve the resistance to hydrogen embrittlement of the parts.

Therefore, an aim of the present disclosure is to provide a steel part which may be used as an assembly part for a motor vehicle, and which has a tensile strength greater than or equal to 1400 MPa, as well as an improved resistance to hydrogen embrittlement.

For this purpose, the present disclosure relates to a method for producing a steel part comprising:

providing a semi-finished product made of a steel comprising, by weight:

0.35%≤C≤0.60%
0.15%≤Si≤0.5%
0.8%≤Mn≤2.0%
0.0003%≤B≤0.01%
0.003%≤Mo≤1.0%
1.0%≤Cr≤2.0%
0.01%≤Ti≤0.04%
0.003%≤N≤0.01%
S≤0.015%
P≤0.015%
0.01%≤Ni≤1.0%
0.01%≤Nb≤0.1%
optionally
0≤Al≤0.1%
0≤V≤0.5%
the remainder consisting of iron and unavoidable impurities, annealing this semi-finished product at an annealing temperature strictly lower than the Ac1 temperature of the steel;

cold forming the semi-finished product into a cold formed product;

subjecting the cold formed product to a heat treatment so as to obtain a steel part, the heat treatment comprising:

heating the cold formed product to a heat treatment temperature greater than or equal to the full austenitisation temperature Ac3 of the steel; and holding the product at a holding temperature comprised between 300° C. and 400° C. for a time comprised between 15 minutes and 2 hours.

According to particular embodiments, the method may comprise one or more of the following features, taken alone or according to any technically possible combination:

During the heating step of the heat treatment, the cold formed product is heated to a heat treatment temperature which is at least 50° C. greater than the full austenitisation temperature Ac3 of the steel.

The annealing temperature is greater than or equal to Ac1 minus 20° C.

The semi-finished product is a wire.

The method further comprises the preparation of the surface of the semi-finished product, comprising cleaning the surface of the semi-finished product and forming a lubricating coating on the surface thereof.

The step of forming a lubricating coating on the surface of the semi-finished product comprises performing a phosphate treatment and a soaping.

The carbon content of the steel is comprised between 0.35 and 0.50 wt %.

The manganese content of the steel is comprised between 0.9 and 1.4 wt %.

The chromium content of the steel is comprised between 1.0 and 1.6 wt %.

The cold forming step is a cold heading step.

During the holding step, the product is held at the holding temperature in an austempering medium, in particular in a salt bath.

The present disclosure also relates to a steel part made of an alloy comprising, by weight:

0.35%≤C≤0.60%
0.15%≤Si≤0.5%
0.8%≤Mn≤2.0%
0.0003%≤B≤0.01%
0.003%≤Mo≤1.0%
1.0%≤Cr≤2.0%
0.01%≤Ti≤0.04%
0.003%≤N≤0.01%
S≤0.015%
P≤0.015%
0.01%≤Ni≤1.0%
0.01%≤Nb≤0.1%
optionally
0≤Al≤0.1%
0≤V≤0.5%
the remainder consisting of iron and unavoidable impurities, the steel part having a microstructure comprising, between 90 area % and 98 area % of bainite, and between 2 area % and 10 area % of martensite-austenite islands, the martensite-austenite islands having a diameter lower than or equal to 50 μm, wherein the steel part has a tensile strength comprised between 1400 MPa and 1800 MPa, and wherein the average prior austenitic grain size is lower than or equal to 20 μm.

According to particular embodiments, the steel part may comprise one or more of the following features, taken alone or according to any technically possible combination:

The carbon content in the martensite-austenite islands is greater than or equal to 1 wt %.

The steel part has a hardness greater than or equal to 400 HV.

The steel part is a cold formed steel part, and more particularly a cold formed and austempered steel part.

The steel part is a cold headed steel part, and more particularly a cold headed and austempered steel part.

The present disclosure will be better understood upon reading the description that follows, given solely by way of example.

In the entire patent application, the contents are indicated in weight % (wt %).

The steel part according to the present disclosure has a composition comprising, by weight:

0.35%≤C≤0.60%
0.15%≤Si≤0.5%
0.8%≤Mn≤2.0%
0.0003%≤B≤0.01%
0.003%≤Mo≤1.0%
1.0%≤Cr≤2.0%
0.01%≤Ti≤0.04%
0.003%≤N≤0.01%
S≤0.015%
P≤0.015%
0.01%≤Ni≤1.0%
0.01%≤Nb≤0.1%
optionally
0≤Al≤0.1%
0≤V≤0.5%
the remainder consisting of iron and unavoidable impurities.

DETAILED DESCRIPTION

For carbon contents below 0.35 wt %, the high strength desired may not be achieved in view of the content of the other elements present in the grade, especially at high holding temperatures during the austempering treatment. For contents greater than 0.60 wt %, the risk of embrittlement increases due to the formation of cementite and to the increase in the hardness. The carbon content is for example lower than or equal to 0.50 wt %.

Silicon acts as a deoxidizer of the steel during its smelting, in the liquid state. Present in solid solution in the solidified metal, it also contributes to increasing the strength of the steel. In particular, at the above-mentioned contents, the silicon has the effect of hardening the bainite microstructure through solid solution hardening. However, it may have a damaging effect if present at too high contents. Indeed, during heat treatments, such as spheroidization treatments, the silicon tends to form intergranular oxides and thus reduces the cohesion of the prior austenite grain boundaries. Too high a content of silicon also reduces the cold deformability of the steel by excessively hardening the matrix. For this reason, the silicon content is limited to 0.5 wt % according to the present disclosure.

At contents comprised between 0.8 and 2.0 wt %, the manganese lowers the bainite start temperature of the steel, and therefore results in a refinement of the bainitic structure and thus increases the mechanical properties of the part. The manganese also has a beneficial effect on the hardenability of the steel and therefore on obtaining the desired final mechanical properties in the parts produced. At contents greater than 2.0%, the manganese tends to accelerate the segregation of the sulfur and the phosphorus at the prior austenite grain boundaries and therefore increases the risk of hydrogen embrittlement of the steel. Preferably, the manganese content is comprised between 0.9 and 1.4 wt %.

Boron is present in the alloy at contents from 0.0003 to 0.01 wt %. By segregating at the prior austenitic grain boundaries, boron, even at very low contents, strengthens the grains boundaries, and makes it possible to increase the resistance to hydrogen-induced delayed fracture. The boron increases the cohesion of the grain boundary via its intrinsic effect, but also by making phosphorus segregation more difficult at these grain boundaries. The boron further strongly increases the hardenability of the steel and thus makes it possible to limit the carbon content needed to obtain the desired bainitic microstructure. Finally, boron acts in synergy with molybdenum and niobium, thus increasing the effectiveness of these elements and their own influence that their respective contents permit. An excess of boron (above 0.01 wt %) would however lead to the formation of brittle iron boro-carbides.

The molybdenum content of the alloy is comprised between 0.003 and 1.0 wt %. Molybdenum interacts strongly with phosphorus, and limits the damaging effect of the phosphorus by limiting its segregation at the prior austenite grain boundaries. Furthermore, it displays a marked carbide-forming behavior. For given mechanical properties, it allows higher holding tempering temperatures during the austempering treatment, which, as a result, favor the development of carbides that will be hydrogen traps. It is therefore an element that increases the resistance to delayed fracture.

The chromium, at contents comprised between 1.0 and 2.0 wt %, lowers the bainite start temperature of the steel, and therefore results in a refinement of the bainitic structure and thus increases the mechanical properties of the part. Furthermore, the chromium has a hardening effect, and contributes to obtaining a high mechanical resistance. Like molybdenum, it slows down the softening during holding during the austempering treatment, allowing higher holding temperatures which favors degassing but also the formation of carbides that trap hydrogen. At contents greater than 2.0 wt %, by excessively increasing the hardness of the steel, it makes it difficult to form it by cold forming, and in particular cold heading. Preferably, the chromium content is comprised between 1.0 and 1.6 wt %.

Titanium is present in the alloy at contents comprised between 0.01 and 0.04 wt %. Titanium is added to the liquid steel in order to increase the hardness of the material. Here, within the ranges indicated, it also increases the delayed fracture resistance in several ways. It contributes to austenitic grain refinement and forms precipitates that trap hydrogen. Finally, the hardening effect of the titanium makes it possible to carry out austempering operations at higher holding temperatures. The maximum titanium content is set here in order to avoid obtaining precipitates of too large a size which would then degrade the resistance of the steel to delayed fracture.

The steel also contain niobium at contents comprised between 0.01 and 0.1 wt %. Niobium improves the hydrogen resistance, as it can on the one hand limit the formation of borocarbides $Fe_3(C,B)$; $Fe_{23}(C,B)_{26}$ which consume, and therefore, lower the "free" boron content available for segregation at the grain boundaries, and, on the other hand, limits the austenitic grain growth by forming carbonitrides. The refinement of grains results in a higher total length of grain boundaries, and therefore in a better distribution of harmful elements, such as phosphorous and sulfur, in lower concentration. Furthermore, a decrease in austenitic grain size results in an acceleration of the kinetics of the bainitic transformation. The maximum niobium content is set in order to avoid obtaining precipitates of too large a size which would then degrade the resistance of the steel to delayed fracture. Furthermore, when it is added in too large an amount, niobium leads to an increased risk of "crack" defects at the surface of the billets and blooms as continually cast. These defects, if they cannot be completely eliminated, may prove very damaging in respect of the integrity of the properties of the final part, especially as regards fatigue strength and hydrogen resistance. This is why the niobium content is kept below 0.1 wt %.

In the steel according to the present disclosure, the nitrogen content is comprised between 0.003 and 0.01 wt %. Nitrogen traps boron via the formation of boron nitrides, which makes the role of this element in the hardenability of the steel ineffective. Therefore, in the steel according to the present disclosure, the nitrogen content is limited to 0.01 wt %. Nevertheless, added in small amounts, it makes it possible, via the formation in particular of titanium nitrides (TiN) and aluminum nitrides (AlN), to avoid excessive austenitic grain coarsening during heat treatments undergone by the steel. Similarly, it also allows, in this case, the formation of carbonitride precipitates that will contribute toward the trapping of hydrogen. Therefore, in the steel according to the present disclosure, the nitrogen content is greater than or equal to 0.003 wt %.

The steel according to the present disclosure comprises at most 0.015 wt % of phosphorus and at most 0.015 wt % of sulfur. The effect of phosphorus and sulfur are particularly harmful in the steels according to the present disclosure, for several reasons. Indeed, since these elements are poisons for hydrogen recombination, they contribute to a higher concentration of atomic hydrogen capable of penetrating into the material, therefore to an increased risk of delayed fracture of the part in use. Moreover, by segregating at the grain boundaries, the phosphorus and the sulfur reduce the cohesion thereof. Their content must therefore be kept very low. For this purpose, measures must be taken to ensure that the steel is dephosphorized and desulfurized during its smelting in the liquid state.

The steel contains from 0.01 to 1.0 wt % of nickel. This element provides an increase in the strength of the steel and has beneficial effects on the resistance to brittle fracture. It also improves, in a known manner, the corrosion resistance of the steel.

The steel optionally contains aluminum at a content at most equal to 0.1 wt %. Aluminum is a deoxidizer of the steel in the liquid state. It then contributes, in the form of nitrides, to controlling austenitic grain coarsening during hot rolling. On the other hand, present in too large an amount, it may lead to a coarsening of aluminate type inclusions in the steel which may prove damaging to the properties of the steel, especially its toughness. In particular, the aluminum content may be comprised at a content between 0.001 and 0.1 wt %.

Further optionally, the steel may comprise vanadium at a content lower than or equal to 0.5 wt %. When it is present, thanks to its hardening effect, the vanadium makes it possible to carry out austempering operations at higher temperatures. The maximum vanadium content is set to avoid obtaining precipitates of too large size which might degrade the resistance of the steel to delayed hydrogen fracture. In particular, the vanadium content may be comprised at a content between 0.05 and 0.5 wt %.

The rest of the composition is iron and unavoidable impurities, in particular resulting from the elaboration.

More particularly, the composition of the steel part consists of the above-mentioned elements.

The steel part according to the present disclosure is more particularly a cold formed steel part, and more particularly a cold headed steel part.

More particularly, the steel part has an average prior austenitic grain size lower than or equal to 20 μm, and for example an average prior austenitic grain size comprised between 8 μm and 15 μm. Such low average prior austenitic grain sizes are typical of cold forming, and more particularly cold heading.

The average prior austenitic grain size is the average size of the austenite just before its transformation upon cooling. The prior austenitic grains may be revealed on the final part, i.e. after cooling, by a suitable method, known to one skilled in the art, for example by etching with a picric acid etching reagent. The prior austenitic grains are observed under an optical microscope or a scanning electron microscope. The grain size of the prior austenitic grains is then determined by image analysis with conventional software known of one skilled in the art.

The steel part has a microstructure comprising, in surface fractions or area %, between 90% and 98% of bainite and between 2% and 10% of martensite-austenite (M/A) islands.

The M/A islands consist of retained austenite at the periphery of the M/A island and of austenite partially transformed into martensite in the center of the M/A island.

The rest of the microstructure comprises, in surface fraction, up to 5% of fresh martensite. In this context, "fresh martensite" designates non tempered or non auto-tempered martensite.

The M/A islands have a diameter lower than or equal to 50 μm, more particularly lower than or equal to 20 μm, and even more particularly comprised between 8 and 15 μm. In this context, "diameter" designates the largest dimension of the M/A island. The diameter of the M/A islands is in particular measured at a magnification of 500:1.

The carbon content in the M/A islands is for example greater than or equal to 1 wt %. This particular carbon content is advantageous, since it stabilizes the retained austenite in the M/A islands against transformation into martensite.

The steel part has a tensile strength comprised between 1400 MPa and 1800 MPa, and more particularly comprised between 1500 MPa and 1800 MPa. In this context, the tensile strength is determined in a conventional manner, in particular according to standard NF EN ISO 6892-1.

The steel part further has a hardness greater than or equal to 400 HV. In this context, the hardness is determined in a conventional manner, in particular according to standard NF EN ISO 6507-1.

The optimized composition and microstructure of the steel part according to the present disclosure allows obtaining a very good resistance to hydrogen embrittlement, associated with a mechanical strength greater than 1400 MPa, more particularly comprised between 1400 and 1800 MPa.

Providing a microstructure comprising between 90 and 98 area % of bainite is advantageous. Indeed, the inventors of the present disclosure have found that such a microstructure results in a good compromise between resistance to hydrogen embrittlement and mechanical strength, and in particular tensile strength. In particular, bainite is less sensitive to hydrogen embrittlement than martensite. Moreover, a tensile strength greater than or equal to 1400 MPa can be obtained with the above-mentioned microstructure.

In particular, the presence of M/A islands at the above-mentioned surface fractions is advantageous for the resistance to hydrogen embrittlement. Indeed, the M/A islands are more ductile than the bainite areas of the microstructure, and further constitute very good hydrogen traps. Therefore, thanks to the presence of the M/A islands, the hydrogen is trapped in relatively ductile areas of the part. This reduces the amount of hydrogen dispersed throughout the microstructure, which is likely to diffuse into the most fragile areas of the part as a result of the stress to which the part is subjected in use, and which might therefore even further reduce the fracture resistance of such fragile areas.

An M/A island surface fraction strictly greater than 10% is not desired, since the retained austenite in the M/A islands transforms, upon application of a stress, into more brittle martensite. Since the M/A islands have previously trapped the hydrogen, this martensite contains a relatively high amount of hydrogen and might therefore constitute a preferred zone for brittle fracture of the part.

The size of the M/A islands mentioned above improves the hydrogen resistance even more, since the hydrogen is then trapped in smaller areas. Furthermore, transformation of the retained austenite of the M/A islands into martensite is less problematic with respect to fracture resistance, since such a transformation would only result in relatively small areas of martensite.

The relatively small size of the prior austenitic grains improves resistance to brittle fracture resistance even more. Indeed, the size of the packets of bainite laths cannot be greater than that of the prior austenite. Therefore, small austenitic prior grains result in relatively small packets of bainite laths, which, in turn, allow for a better distribution of the hydrogen which tends to segregate at the grain joints. Such an improved distribution of the hydrogen that may be present in the bainite areas of the microstructure therefore increases the resistance of the part to brittle fracture.

The steel part for example has a yield strength greater than or equal to 1080 MPa.

Preferably, the steel part has an elongation greater than or equal to 8% and/or a reduction of area greater than or equal to 44%. The elongation and the reduction of area are measured according to conventional methods, and in particular in accordance with standard NF EN ISO 6892-1.

The steel parts according to the present disclosure may advantageously be used as parts for engine, transmissions and axle applications for motor vehicles. In particular, these steel parts may be used as bolts and screws for such applications, and for example cylinder head bolts, main bearing cap bolts and connecting rod bolts.

The diameter of the steel part is for example lower than or equal to 20 mm, and more particularly lower than or equal to 16 mm, and even more particularly lower than or equal to 12 mm. More particularly, the diameter of the steel part is for example greater than or equal to 5.5 mm.

The steel part described above may, for example, be obtained using a method comprising:

providing a semi-finished product made of steel;

annealing this semi-finished product at an annealing temperature strictly lower than the Ac1 temperature of the steel;

cold forming the semi-finished product into a cold formed product;

subjecting the cold formed product to a heat treatment so as to obtain a cold formed steel part, the heat treatment comprising:

heating the cold formed product to a heat treatment temperature greater than or equal to the full austenitization temperature (Ac3) of the steel; and then holding the product at a holding temperature comprised between 300° C. and 400° C. for a time comprised between 15 minutes and 2 hours.

In particular, the method for producing the steel part does not comprise any intermediate quenching steps.

The semi-finished product provided during the provision step has the following composition, by weight:

$0.35\% \leq C \leq 0.60\%$
$0.15\% \leq Si \leq 0.5\%$
$0.8\% \leq Mn \leq 2.0\%$
$0.0003\% \leq B \leq 0.01\%$
$0.003\% \leq Mo \leq 1.0\%$
$1.0\% \leq Cr \leq 2.0\%$
$0.01\% \leq Ti \leq 0.04\%$
$0.003\% \leq N \leq 0.01\%$
$S \leq 0.015\%$
$P \leq 0.015\%$
$0.01\% \leq Ni \leq 1.0\%$
$0.01\% \leq Nb \leq 0.1\%$
optionally
$0 \leq Al \leq 0.1\%$
$0 \leq V \leq 0.5\%$
the remainder consisting of iron and unavoidable impurities.

This composition corresponds to the composition previously described for the steel part.

The semi-finished product is in particular a wire, having, for example, a diameter comprised between 5 mm and 25 mm.

As mentioned above, the annealing step is performed at an annealing temperature strictly lower than the Ac1 temperature of the steel. As is conventional, the Ac1 temperature is the temperature at which austenite begins to form during heating.

The annealing step is intended for temporarily decreasing the tensile strength of the steel so as to prepare it for cold forming. For example, at the end of the annealing step, the steel has a tensile strength lower than or equal to 600 MPa. Such an annealing is called globulization or spheroization annealing.

More particularly, during the annealing step, the semi-finished product is heated to an annealing temperature greater than or equal to Act-20° C.

During the annealing step, the semi-finished product is preferably held at the annealing temperature for a time which is chosen, as a function of the annealing temperature, such that the tensile strength of the steel after annealing is lower than or equal to 600 MPa. For example, the holding time at the annealing temperature is comprised between 5 and 9 hours.

According to a particular example, the annealing step is performed at an annealing temperature equal to 730° C., and the holding time at the annealing temperature is equal to 7 hours.

The annealing step is preferably carried out in a neutral atmosphere, for example in an atmosphere consisting of nitrogen gaz.

After holding at the annealing temperature, the semi-finished product is cooled down to room temperature.

The cooling is preferably performed at a speed chosen so as to avoid the precipitation of pearlite and the formation of bainite, and thus so as to maintain a tensile strength smaller than or equal to 600° C. after cooling. This cooling speed can be determined without difficulty using the CCT diagrams of the steel.

According to a particular example, the cooling from the annealing temperature is performed in three stages: a first cooling stage from the annealing temperature to about 670° C., where the steel is cooled at a cooling speed smaller than or equal to 25° C./h, a second cooling stage from about 670° C. to about 150° C. at a cooling speed smaller than or equal to 250° C./s and a third cooling stage, from about 150° C. down to ambient temperature at a cooling speed corresponding to cooling in ambient or natural air. This three-step cooling and the corresponding temperatures and speeds are given only by way of example, and different temperatures and speeds may be used depending in particular on the composition of the steel and on the final tensile strength desired.

The cold forming step is, for example, a cold heading step, such that a cold headed product is obtained at the end of the cold forming step, and a cold headed steel part is obtained at the end of the heat treatment.

The method optionally comprises, between the annealing and the cold heading step, a step of cold drawing the annealed semi-finished product so as to reduce a diameter thereof. This cold drawing step is in particular a wire drawing step. During this wire drawing step, the reduction in diameter is for example lower than or equal to 5%.

Preferably, the cold drawing step is preceded by a surface preparation comprising cleaning the surface of the semi-finished part, followed by a step of forming a lubricating coating on the surface of the semi-finished part.

The cleaning step for example comprises a degreasing and/or a mechanical or chemical descaling or pickling, optionally followed by a neutralization. In this context, neutralization is a cleaning process used to clean all the alien particles or substances from the surface of the steel in order to reduce the risk of corrosion.

The step of forming a lubricating coating for example comprises a phosphate treatment and a soaping.

This small grain size results from the use of a cold forming method, and more particularly cold heading, for producing the steel part. This austenite grain size is the prior austenite grain size of the cold formed and austempered steel part according to the present disclosure.

The heat treatment temperature is for example higher by a least 50° C. than the full austenitisation temperature Ac3 of the steel.

More particularly, during the heating step, the steel part is held at the heat treatment temperature for a time comprised between 5 minutes and 120 minutes.

Preferably the holding temperature during the holding step is comprised between 300 and 380° C.

At the end of the holding step, a cold formed, and more particularly cold headed, and austempered steel part is obtained.

The thus obtained steel part has the microstructure described above for the steel part.

Experiments

Laboratory tests were carried out on castings having the chemical compositions C1 to C3, Ref1 and Ref 2 mentioned in Table 1 below.

TABLE 1

Chemical compositions of the castings

| No | C | Si | Mn | B | Mo | Cr | Ti | N | S | P | Ni | Nb | Al |
|---|---|---|---|---|---|---|---|---|---|---|---|---|---|
| C1 | 0.38 | 0.35 | 1.1 | 0.0025 | 0.1 | 1.5 | 0.025 | 0.005 | 0.005 | 0.005 | 0.5 | 0.05 | 0.025 |
| C2 | 0.38 | 0.25 | 1.3 | 0.0025 | 0.1 | 1.5 | 0.025 | 0.005 | 0.005 | 0.005 | 0.1 | 0.05 | 0.025 |
| C3 | 0.42 | 0.15 | 0.9 | 0.0008 | 0.2 | 1.5 | 0.020 | 0.005 | 0.005 | 0.005 | 0.15 | 0.05 | 0.025 |
| Ref1 | 0.46 | 0.17 | 0.82 | 0 | 0.2 | 1.0 | 0 | 0.01 | 0.011 | 0.01 | 0.08 | 0 | 0.018 |
| Ref2 | 0.36 | 0.04 | 0.09 | 0 | 0.005 | 1.0 | 0 | 0.006 | 0.006 | 0.01 | 0.017 | 0 | 0.033 |

After cold forming, the cold formed product is subjected to the heat treatment so as to obtain the cold formed steel part, the heat treatment comprising:

heating the cold formed product to the heat treatment temperature greater than or equal to the full austenitization temperature Ac3 of the steel; and then holding the product at the holding temperature comprised between 300° C. and 400° C. for a time comprised between 15 minutes and 2 hours.

This heat treatment is an austempering heat treatment.

According to an example, during the holding step, the product is held at the holding temperature in an austempering medium. The austempering medium is for example a salt bath.

In particular, during the heat treatment, the cold formed product is cooled from the heat treatment temperature to the holding temperature, preferably in the austempering medium. In particular, the product is cooled from the heat treatment temperature to the holding temperature in the salt bath.

After the end of the holding step, the products are allowed to cool down to the ambient temperature in ambient or natural air.

The heating step is carried out in such a manner that the steel part has an entirely austenitic microstructure at the end of the heating step.

The average size of the austenite grains formed during this heating step is lower than or equal to 20 μm, and in particular comprised between 8 and 15 μm. This size is, for example, measured with a magnification of 500:1.

In the above Table 1, the compositions are indicated in wt %.

In all of the above compositions, the remainder of the composition consists of iron and unavoidable impurities. In particular, depending on its manufacturing process, and especially when it is smelted from scrap iron, the steel may contain up to 0.15% of copper as an unavoidable impurity.

Compositions Ref1 and Ref2 are reference compositions.

In a first series of experiments, all of the above castings were subjected to annealing comprising holding the casting at a temperature of 730° C. with a holding time of 7 hours, followed by cooling. Cooling was performed in three stages comprising cooling at a cooling speed of 25° C./h down to 670° C., followed by cooling at 250° C./h until 150° C., and finally natural or ambient air cooling down to room temperature. These cooling speeds were obtained by adjusting the heating conditions in the annealing furnace accordingly, the heating being reduced or turned off depending on the needs, in a manner known to the skilled person.

After annealing, the castings were subjected to cold forming into a cold formed product.

In experiments E1 to E4 and E6 (see Table 2 below), the cold formed products were then subjected to an austempering heat treatment comprising:

heating the cold formed product to a heat treatment temperature $T_t$ and holding it at this temperature for a holding time $t_t$; and then holding the product at a holding temperature $T_h$ for a holding time $t_h$ in a salt bath.

The products were then allowed to cool down to the room temperature in natural or ambient air.

In experiment E5, a cold formed product made of the alloy having the composition Ref2, was subjected to a heat treatment consisting of quenching, followed by tempering after cold heading, instead of the austempering treatment described above. More particularly, in this experiment, the heat treatment consisted of heating to a temperature of 890° C. and holding for 30 minutes at this temperature, followed by quenching at a cooling speed greater than the critical martensitic cooling speed, and then tempering at 450° C. for 60 minutes.

The below Table 2 indicates, for the different experiments E1 to E6, the compositions of the steel products, the diameters of the cold formed products, as well as, where applicable, the heat treatment conditions.

TABLE 2

| Heat treatment conditions | | | | | | | | |
|---|---|---|---|---|---|---|---|---|
| Experiment | Alloy | Diameter (mm) | $T_A$(° C.) | $t_r$ (min) | $T_B$(° C.) | $t_B$(min) | Ac1 | Ac3 |
| E1 | C1 | 12 | 890 | 30 | 325 | 45 | 732 | 791 |
| E2 | C2 | 12 | 890 | 30 | 325 | 45 | 738 | 793 |
| E3 | C3 | 12 | 890 | 30 | 325 | 45 | 749 | 786 |
| E4 | Ref1 | 12.5 | 890 | 30 | 325 | 45 | 734 | 782 |
| E5 | Ref2 | 11 | n.a. | n.a. | n.a. | n.a. | 750 | 795 |
| E6 | Ref1 | 12.5 | 890 | 30 | 300 | 45 | 734 | 782 |

In the above Table 2, n.a. means "non applicable".

In the above Table 2, the reference experiments are underlined (experiments E4 to E6).

Tensile tests were performed using test specimen type TR03 (Ø=5 mm, L=75 mm). The tensile testing was performed according to standard NF EN ISO 6892-1, i.e. with a cross head speed of 8 mm/mn. Each value is the average of three measurements.

A hardness profile along the cross section of the samples was performed. Vickers hardness tests were carried out under a load of 30 kg for 15 seconds durations. The hardness was measured according to standard NF EN ISO 6507-1. Each value is the average of three measurements.

The results of these tests are summarized in Table 3 below.

Furthermore, the microstructure of the thus obtained products was analyzed based on cross-sections of these products. More particularly, the structures present in the cross-sections were characterized by light optical microscopy (LOM) and by scanning electron microscopy (SEM). The LOM and SEM observations were performed after etching using a Nital containing solution.

The microstructures of the steels were characterized using colour etching for distinguishing martensite, bainite and ferrite phases using the LePera etchant (LePera 1980). The etchant is a mixture of 1% aqueous solution of sodium metabisulfite (1 g Na2S205 in 100 ml distilled water) and 4% picral (4 g dry picric acid in 100 ml ethanol) that are mixed in a 1:1 ratio just before use.

LePera etching reveals primary phases and second phases such as type of bainite (upper, lower), martensite, islands and films of austenite or M/A islands. After a LePera etching, ferrite appears light blue, bainite from blue to brown (upper bainite in blue, lower bainite in brown), martensite from brown to light yellow and M/A islands in white, under a light optical microscope and at a magnification of 500:1.

The amount of M/A islands in percentage for a given area, as well as the diameter of the islands in the images were measured using an adapted image processing software, in particular the ImageJ software of processing and image analysis allowed quantifying.

Prior austenitic grain size was determined after Béchet-Beaujard etching by image type comparison according to the standard NF EN ISO 643. Each value is the average of three measurements.

The results of these analyses are summarized in the following Table 4.

In Tables 3 and 4, the following abbreviations are used:

TS (MPa) refers to the tensile strength measured by tensile test in the longitudinal direction relative to the rolling direction, YS (MPa) refers to the yield strength measured by tensile test in the longitudinal direction relative to the rolling direction, Ra (%) refers to the percent reduction of area measured by tensile test in the longitudinal direction relative to the rolling direction, El (%) refers to the elongation measured by tensile test in the longitudinal direction relative to the rolling direction, HV30 refers to the result of the hardness measurement, M/A=Martensite/retained austenite islands

TABLE 3

| Mechanical properties of the samples | | |
|---|---|---|
| | Ys (MPa) | Ts (MPa) |
| E1 | 1177 | 1531 |
| E2 | 1194 | 1520 |
| E3 | 1234 | 1520 |
| E4 | 1035 | 1331 |
| E5 | 1163 | 1247 |
| E6 | 1250 | 1562 |

TABLE 4

| Microstructure of the samples | | | | | |
|---|---|---|---|---|---|
| N° | Bainite (area %) | M/A islands (area %) | Martensite (area %) | Diameter of M/A islands (μm) | Prior austenitic grain size (μm) |
| E1 | 93 | 7 | 0 | 6 | 10.6 |
| E2 | 95 | 5 | 0 | 10 | 12.1 |
| E3 | 97 | 3 | 0 | 8 | 9.6 |
| E4 | 99 | 0 | 1 | n.a. | 11.3 |
| E5 | 0 | 0 | 100 | n.a. | n.a. |
| E6 | 99 | 0 | 1 | n.a. | 11.3 |

In the above Table 4, n.a. means "non applicable".

Finally, for each of the experiments E1 to E6, the hydrogen resistance of the corresponding samples was determined by comparison of the results of a slow strain rate tensile test (strain rate of $10^{-5}$ $s^{-1}$) on an uncharged sample and on a sample charged with hydrogen (Standard NF A-05-304).

More particularly, the inventors determined the ductility (through the percent reduction of area Ra) on the charged and uncharged samples, and compared the results through an embrittlement index.

The total H2 content inside samples before charging was equal to about 0.3 ppm.

Hydrogen charging was performed through cathodic charging using an electrolytic solution composed of $H_2SO_4$ 1N with the addition of an hydrogen promoter Thiourea 2.5 mg/L, with a current density I=0.8 mA/cm$^2$ for 5 hours.

For each pair of samples (charged and uncharged), the embrittlement index $I_{Ra}$ relating to the percent reduction of area is calculated using the following formula:

$I_{Ra}$=1−[Ra(H2)/Ra(H2=0)], where Ra(H2) corresponds to the value of the percent reduction of area measured on the sample charged with hydrogen, and Ra(H2=0) corresponds to the value of the percent reduction of area measured on the uncharged sample.

An embrittlement index $I_{Ra}$ close to 1 means that the grade is very sensitive to Hydrogen Embrittlement. An embrittlement index $I_{Ra}$ lower than or equal to 0.35 was considered satisfactory in view of the desired applications.

The inventors further observed the fracture surface mode in each case.

The results of these tests are summarized in Table 5.

TABLE 5

Results of hydrogen resistance tests

| | without | with H2 | | | |
|---|---|---|---|---|---|
| Exp. | H2 Ra (%) | Ra (%) | total H2 (ppm) | Embrittlement index $I_{Ra}$ | Fracture surface mode |
| E1 | 52.4 | 46.9 | 1.10 | 0.10 | Ductile |
| E2 | 55.4 | 44.6 | 1.23 | 0.19 | Ductile |
| E3 | 60.5 | 53.9 | 1.09 | 0.11 | Ductile |
| E4 | 60.3 | 28.1 | 2.56 | 0.53 | Intergranular + mainly brittle fracture |
| E5 | 51.8 | 13.2 | 1.02 | 0.75 | Intergranular + ductile fracture |
| E6 | 55.45 | 1.2 | 3.90 | 0.98 | Fracture before Ts |

As can be seen from the above Table 5, the ductility is significantly affected by hydrogen.

The steels having compositions C1 to C3 (see experiments E1 to E3) exhibit a higher hydrogen resistance than the reference grade Ref2 after quenching and tempering (see experiment E5) and the reference grade Ref1 after an austempering heat treatment (see experiments E4 and E6).

Furthermore, a ductile fracture mode is observed in the case of experiments E1 to E3, while an intergranular fracture mode or the occurrence of a fracture before Ts is observed for comparative experiments E4 to E6.

The comparison of the samples having a bainite content greater than or equal to 90% (experiments E1 to E3) with the sample having a martensitic microstructure (experiment E5) shows that the bainitic structure is less sensitive to hydrogen embrittlement than the martensitic structure.

It can finally be observed that the samples according to the present disclosure (experiments E1 to E3) absorb less hydrogen under the same charging conditions than the comparative samples according to experiments E4 and E6.

Therefore, these experiments show that the steel parts according to the present disclosure are particularly well adapted for applications as mentioned above, such as for assembly parts for motor vehicles. Indeed, they have very good mechanical properties, and in particular a good tensile strength, associated with an improved resistance to hydrogen embrittlement as compared to prior art steel parts.

The method according to the present disclosure further has the advantage that it allows obtaining, after annealing, a sufficiently low tensile strength so as to enable the use of conventional cold forming tools, and reduce the wear thereof, while at the time resulting in final parts having a high tensile strength (greater than or equal to 1400 MPa).

What is claimed is:

1. A steel part made of an alloy comprising, by weight:
0.35%≤C≤0.60%;
0.15%≤Si≤0.5%;
0.8%≤Mn≤2.0%;
0.0003%≤B≤0.01%;
0.003%≤Mo≤1.0%;
1.0%≤Cr≤2.0%;
0.01%≤Ti≤0.04%;
0.003%≤N≤0.01%;
S≤0.015%;
P≤0.015%;
0.01%≤Ni≤1.0%; and
0.01%≤Nb≤0.1%;
optionally
0≤Al≤0.1%; and
0≤V≤0.5%; and
a remainder consisting of iron and unavoidable impurities,
wherein the steel part has a microstructure comprising, between 90 area % and 98 area % of bainite, and between 2 area % and 10 area % of martensite-austenite islands, the martensite-austenite islands having a diameter lower than or equal to 50 μm, wherein the steel part has a tensile strength comprised between 1400 MPa and 1800 MPa, and wherein an average prior austenitic grain size is lower than or equal to 20 μm,
wherein the steel part is a cold formed steel part.

2. The steel part according to claim 1, wherein the carbon content in the martensite-austenite islands is greater than or equal to 1 wt %.

3. The steel part according to claim 1, wherein the steel part has a hardness greater than or equal to 400 HV.

4. The steel part according to claim 1, wherein the steel part is a cold formed and austempered steel part.

5. The steel part according to claim 1, wherein the steel part is a cold headed steel part.

6. The steel part according to claim 5, wherein the steel part is a cold headed and austempered steel part.

7. The steel part according to claim 1, wherein 0.35%≤C≤0.42%.

8. The steel part according to claim 1, wherein 0.15%≤Si≤0.35%.

9. A steel part made of an alloy consisting of, by weight:
0.35%≤C≤0.60%;
0.15%≤Si≤0.5%;
0.8%≤Mn≤2.0%;
0.0003%≤B≤0.01%;
0.003%≤Mo≤1.0%;
1.0%≤Cr≤2.0%;
0.01%≤Ti≤0.04%;
0.003%≤N≤0.01%;
S≤0.015%;
P≤0.015%;

0.01%≤Ni≤1.0%; and
0.01%≤Nb≤0.1%;
optionally
0≤Al≤0.1%; and
0≤V≤0.5%; and
a remainder consisting of iron and unavoidable impurities,
wherein the steel part has a microstructure comprising, between 90 area % and 98 area % of bainite, and between 2 area % and 10 area % of martensite-austenite islands, the martensite-austenite islands having a diameter lower than or equal to 50 μm, wherein the steel part has a tensile strength comprised between 1400 MPa and 1800 MPa, and wherein an average prior austenite grain size is lower than or equal to 20 μm,
wherein the steel part is a bolt or a screw intended for use in engine, transmission or axle applications for motor vehicles.

10. The steel part according to claim 9 wherein the bolt or the screw includes a head and threads.

11. The steel part according to claim 1 wherein the steel part is a bolt or a screw intended for use in engine, transmission or axle applications for motor vehicles.

12. A method for producing a steel part comprising:
providing a semi-finished product made of a steel comprising, by weight:
0.35%≤C≤0.60%;
0.15%≤Si≤0.5%;
0.8%≤Mn≤2.0%;
0.0003%≤B≤0.01%;
0.003%≤Mo≤1.0%;
1.0%≤Cr≤2.0%;
0.01%≤Ti≤0.04%;
0.003%≤N≤0.01%;
S≤0.015%;
P≤0.015%;
0.01%≤Ni≤1.0%; and
0.01%≤Nb≤0.1%;
optionally
0≤Al≤0.1%; and
0≤V≤0.5%; and
a remainder consisting of iron and unavoidable impurities;
annealing the semi-finished product at an annealing temperature strictly lower than an Ac1 temperature of the steel;
cold forming the semi-finished product into a cold formed product; and
subjecting the cold formed product to a heat treatment so as to obtain the steel part as recited in claim 1, the heat treatment comprising:
heating the cold formed product to a heat treatment temperature greater than or equal to a full austenitisation temperature Ac3 of the steel; and
holding the product at a holding temperature comprised between 300° C. and 400° C. for a time comprised between 15 minutes and 2 hours.

13. The method according to claim 12, wherein, during the heating step of the heat treatment, the cold formed product is heated to a heat treatment temperature which is at least 50° C. greater than the full austenitisation temperature Ac3 of the steel.

14. The method according to claim 12, wherein the annealing temperature is greater than or equal to Ac1 minus 20° C.

15. The method according to claim 12, wherein the semi-finished product is a wire.

16. The method according to claim 12, further comprising preparing a surface of the semi-finished product, comprising cleaning the surface of the semi-finished product and forming a lubricating coating on the surface thereof.

17. The method according to claim 16, wherein the step of forming of the lubricating coating on the surface of the semi-finished product comprises performing a phosphate treatment and a soaping.

18. The method according to claim 12, wherein the carbon content of the steel is comprised between 0.35 and 0.50 wt %.

19. The method according to claim 12, wherein the manganese content of the steel is comprised between 0.9 and 1.4 wt %.

20. The method according to claim 12, wherein the chromium content of the steel is comprised between 1.0 and 1.6 wt %.

21. The method according to claim 12, wherein the cold forming step is a cold heading step.

22. The method according to claim 12, wherein, during the holding step, the product is held at the holding temperature in a salt bath.

* * * * *